US007921606B2

(12) United States Patent
Quaranta et al.

(10) Patent No.: US 7,921,606 B2
(45) Date of Patent: Apr. 12, 2011

(54) HIP, RIDGE OR RAKE SHINGLE

(75) Inventors: Joseph Quaranta, Yardley, PA (US); Stephen A. Koch, Collegeville, PA (US); Robert L. Jenkins, Honey Brook, PA (US); Gregory F. Jacobs, Oreland, PA (US); Karen L. Steele, Downingtown, PA (US)

(73) Assignee: CertainTeed Corporation, Valley Forge, PA (US)

( * ) Notice: Subject to any disclaimer, the term of this patent is extended or adjusted under 35 U.S.C. 154(b) by 954 days.

(21) Appl. No.: 11/315,451

(22) Filed: Dec. 22, 2005

(65) Prior Publication Data

US 2007/0144077 A1 Jun. 28, 2007

(51) Int. Cl.
*E04B 7/02* (2006.01)

(52) U.S. Cl. ..... 52/57; 52/518

(58) Field of Classification Search ..... 52/57, 518, 52/523, 528, 746.11, 748.11; 454/365; 428/141; 206/323, 324; 83/920; 156/71
See application file for complete search history.

(56) References Cited

U.S. PATENT DOCUMENTS

| | | | | | |
|---|---|---|---|---|---|
| 1,108,884 | A * | 9/1914 | Bird | 52/518 |
| 1,153,418 | A * | 9/1915 | Bird | 52/518 |
| 1,184,509 | A * | 5/1916 | Bird | 52/518 |
| 1,185,509 | A * | 5/1916 | Bird | 248/312 |
| 1,547,498 | A * | 7/1925 | Jordan | 52/748.1 |
| 2,209,271 | A * | 7/1940 | Harshberger | 52/539 |
| 2,230,922 | A * | 2/1941 | Young | 52/276 |
| 2,253,753 | A * | 8/1941 | Black | 52/545 |
| 4,404,783 | A * | 9/1983 | Freiborg | 52/518 |
| 4,439,955 | A * | 4/1984 | Freiborg | 52/57 |
| 5,052,162 | A | 10/1991 | Bush et al. | |
| 5,054,254 | A * | 10/1991 | Sells | 52/199 |
| 5,319,898 | A * | 6/1994 | Freiborg | 52/52 |
| 5,951,809 | A | 9/1999 | Jenkins et al. | |
| 6,182,400 | B1 * | 2/2001 | Freiborg et al. | 52/57 |
| 6,237,288 | B1 * | 5/2001 | Jenkins et al. | 52/105 |
| 6,351,913 | B1 | 3/2002 | Freiborg et al. | |
| 6,725,609 | B2 | 4/2004 | Freiborg et al. | |
| 6,758,019 | B2 * | 7/2004 | Kalkanoglu et al. | 52/553 |
| 6,874,289 | B2 * | 4/2005 | Koch et al. | 52/543 |
| 2003/0196389 | A1 * | 10/2003 | Naipawer, III | 52/57 |
| 2005/0072092 | A1 * | 4/2005 | Williams | 52/518 |
| 2005/0210806 | A1 * | 9/2005 | Guerra | 52/518 |

* cited by examiner

*Primary Examiner* — Brian E Glessner
*Assistant Examiner* — Christine T Cajilig
(74) *Attorney, Agent, or Firm* — Paul & Paul

(57) ABSTRACT

A hip, ridge or rake shingle comprised of a plurality of panels sandwiched on each panel portion side of a layer of shingle material, such that each panel portion can be folded along a fold line, and wherein tabs are provided for each panel portion, adapted to be bent backwardly upon themselves, sandwiching thickening panels therebetween. The shingles can be laid up on a hip, ridge or rake of a roof, to yield desirable thickened features.

15 Claims, 8 Drawing Sheets

Fig. 2
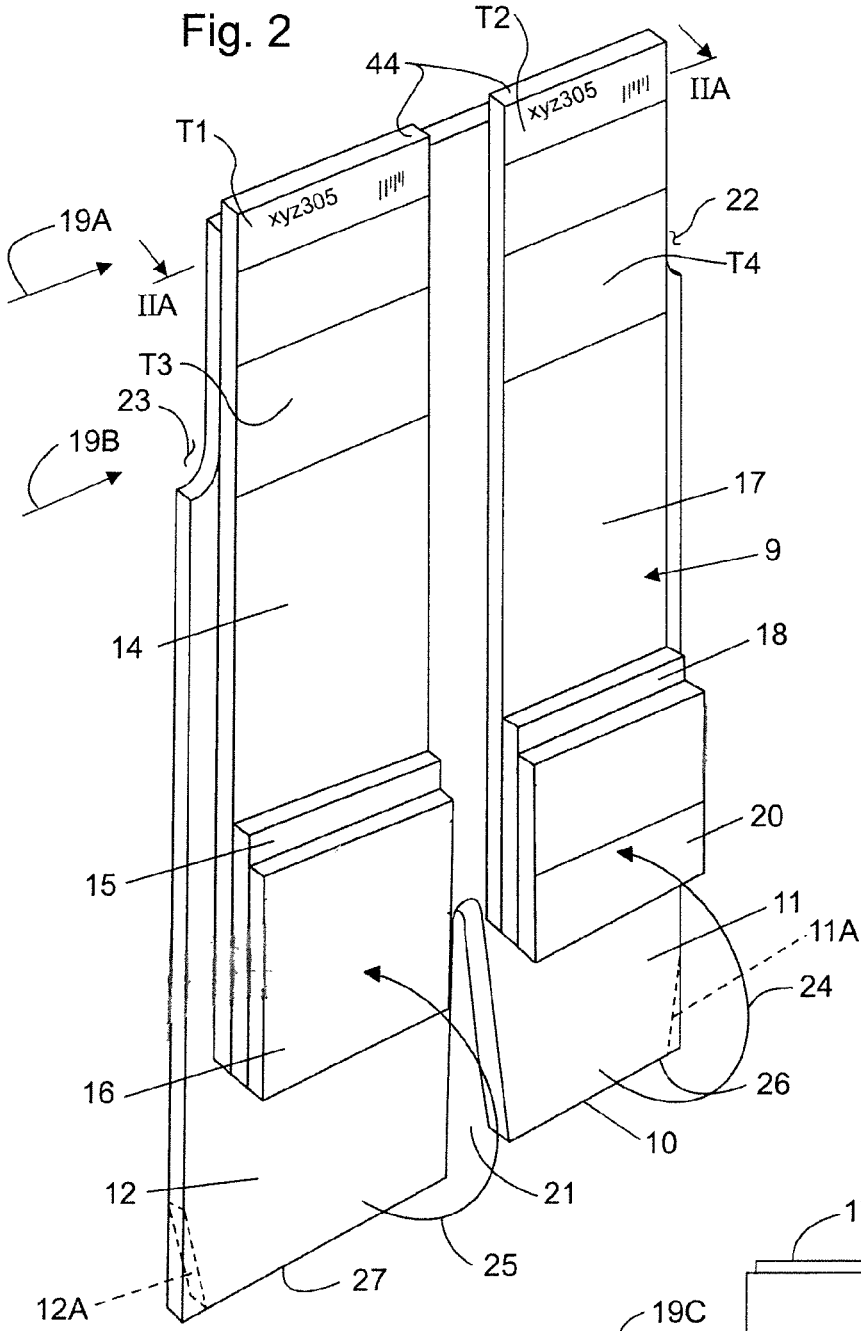
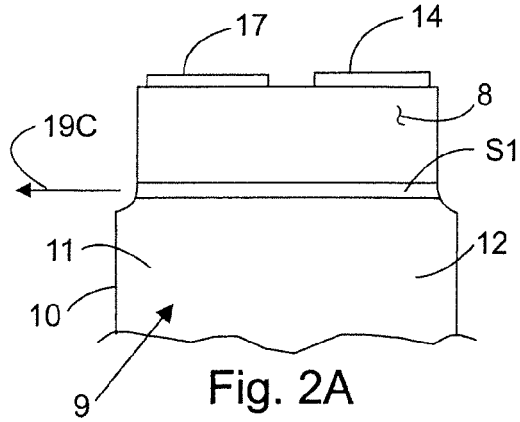
Fig. 2A

HIP, RIDGE OR RAKE SHINGLE

BACKGROUND OF THE INVENTION

The present invention is directed to a hip, ridge or rake shingle.

In the roofing art, it is known to make hip, ridge or rake shingles of asphalt composition, generally comprising a mat, having asphalt on each surface and with granules on an outer surface and other particles such as mica, sand, or smaller granules on an underneath surface. It is also known that, when shingling a roof, it is desirable to have separate shingles for placement along hips of a roof and along the upper ridge or rake of a roof, to give a finished appearance to the roof. This is to be distinguished from cutting out shingle pieces from generally flat roofing materials, and applying them to the hip, ridge or rake, such that different sloped planar surfaces of hips, ridges or rake are covered. By the use of separate such shingles, different aesthetic considerations can be built into the hip, ridge or rake shingles, to yield a richer, thicker appearance to the shingles, to simulate natural shingle materials, such as slate, tile, wood shakes, or the like.

In addition, various design configurations can be built into the hip, ridge or rake shingle.

Other hip, ridge or rake shingles that are known in the prior art, are as disclosed in U.S. Pat. Nos. 6,182,400; 6,351,913; and 6,725,609. Such shingles give the appearance of substantial thickness, in having the functional feature of a plurality of layers of shingle material that are bent back upon themselves, such that two separate layers are folded inwardly beneath the major portion of the shingle, to yield a thick-appearing edge that is curved at the front of each shingle, which functions to provide the desired thickness. However, such shingles, because they involve two generally laminated layers of shingle material being folded essentially 180° back upon themselves, can have the disadvantage that cracks can form because of the thickness of the double fold, presenting weathering and aesthetic considerations that may not be the most desirable.

SUMMARY OF THE INVENTION

The present invention is directed to providing a hip, ridge or rake shingle that can be constructed to provide a thick appearance when laid up on a hip, ridge or rake of a roof, wherein the thickness is provided by having a plurality of panels on each side of a panel portion of a shingle, where each panel portion is foldably connected to the other, and wherein the individual panels that are provided on each panel portion are stacked to provide the thickness, and wherein extended tabs on each panel portion are folded backwardly, to sandwich the stacked panels between the visible outer portion of each shingle and the tab that is folded back and underlying the stacked panels. In doing so, the thickness of the shingle can be varied, depending upon the number of panels that are stacked between the rearwardly folded tabs and the related folded panel portions, to create a shingle of the desired thickness, and wherein only the outer single layer of shingle material is folded back about 180° to establish the fold, to eliminate or at least substantially reduce the likelihood of cracking at the fold of that outer layer of shingle material, where it is folded back.

Accordingly, it is a primary object of this invention to provide a novel hip, ridge or rake shingle.

It is another object of this invention to provide a novel roof constructed, in part, of the plurality of said hip, ridge or rake shingles.

It is a further object of this invention to provide a novel method of making a thick-appearing hip, ridge or rake shingle.

Other objects and advantages of the present invention will be readily apparent upon a reading of the following descriptions of the drawing figures, the detailed descriptions of the preferred embodiments, and the appended claims.

BRIEF DESCRIPTIONS OF THE DRAWING FIGURES

FIG. 1 is a layout of a plurality of components that make up the shingle in accordance with this invention, wherein a major panel is provided at the center of the layout, comprising two panel portions connected together, having on each side a plurality of additional panels that will be stacked upon the panel portions at the center of the layout.

FIG. 2 is a vertical perspective view of the underside of the shingle of this invention, showing a plurality of panels of shingle material, stacked on adjacent panel portions of a panel that is to comprise a hip, ridge or rake shingle, with the panel portions at their lower ends having extended tabs, about to be rotated 180°, as shown by the arrows, to complete the formation of a shingle, and with release tape across the undersides of a plurality of the panels.

FIG. 2A is a fragmentary top view of the shingle of this invention, taken substantially along the line IIA-IIA of FIG. 2, and showing a line of sealant on the top surface of the shingle.

Figures 3, 3A:
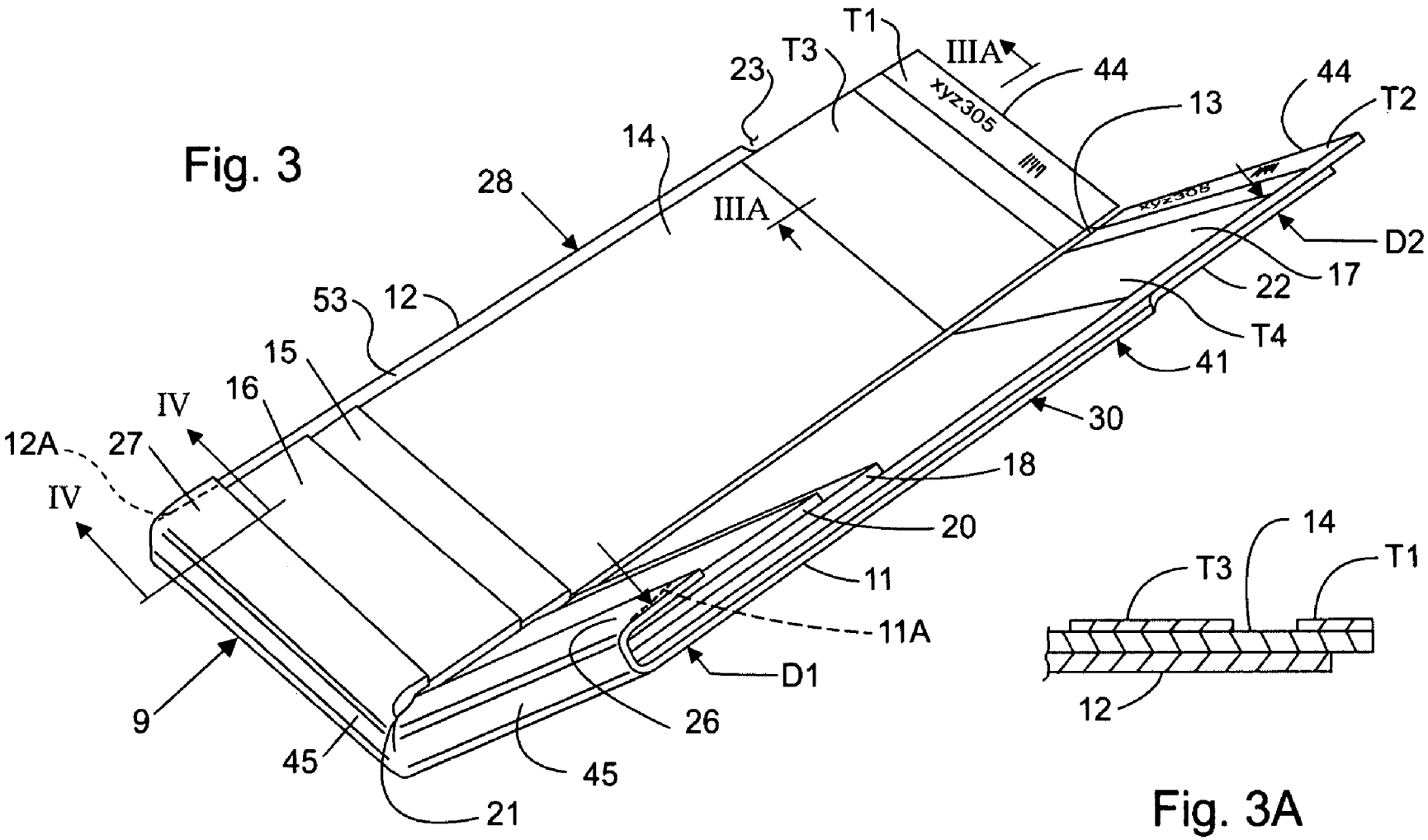
FIG. 3 is a perspective view of the shingle of FIG. 2, with the tabs folded upwardly about themselves, to sandwich the panels between the connected panel portions of the shingle, with the illustration of FIG. 3 being of the underneath of a shingle thus constructed.
FIG. 3A is a fragmentary sectional view of a portion of the shingle of FIG. 3, taken generally along the line IIIA-IIIA of FIG. 3.
Figure 4:
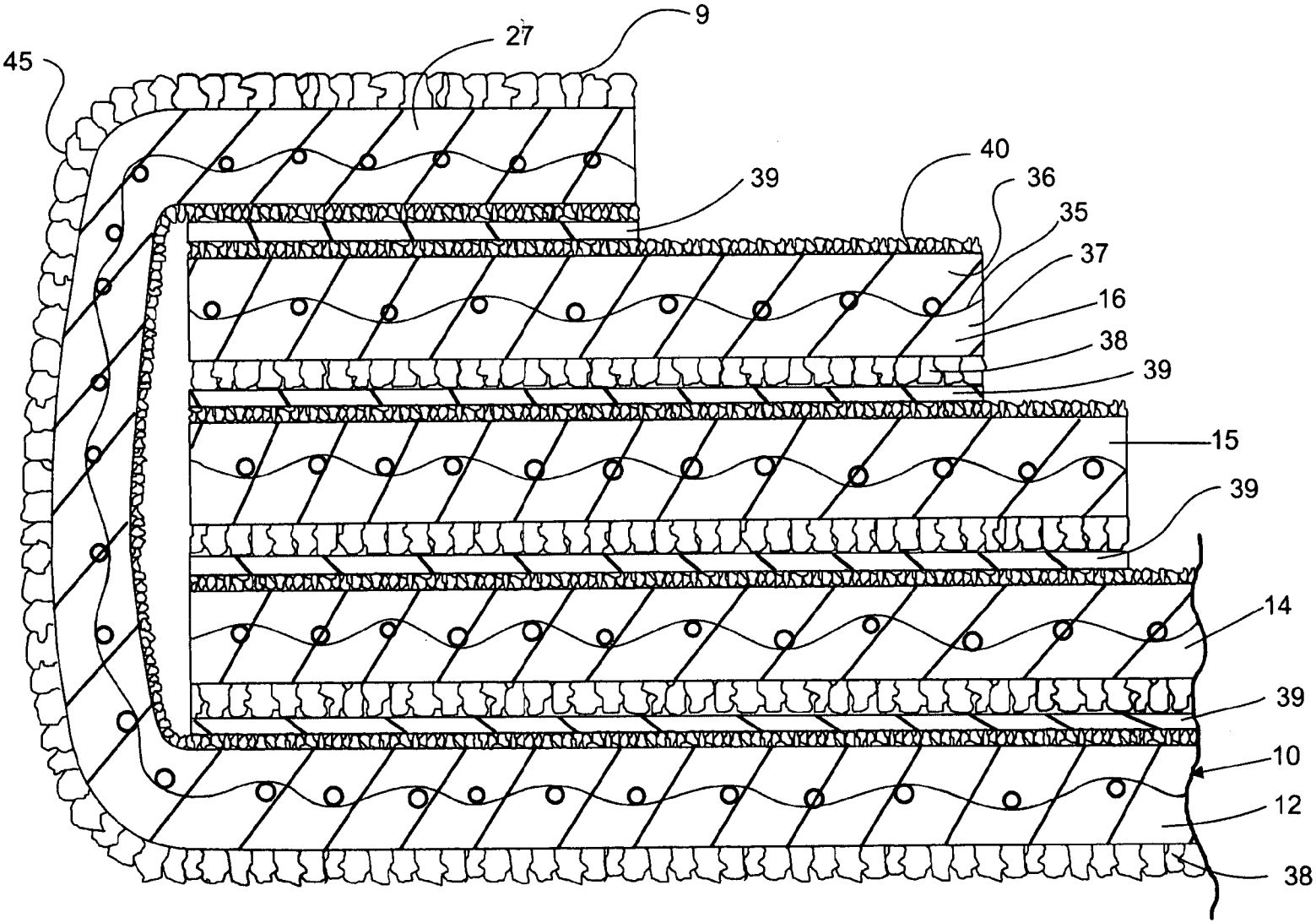
FIG. 4 is a greatly enlarged sectional view of the panels of FIG. 3 sandwiched together, as would be seen taken along the line of IV-IV of FIG. 3, and wherein the details of construction of the individual layers of shingle material are also illustrated, with the illustration of FIG. 4 being a fragmental illustration of a lower end of the hip, ridge or rake shingle shown in FIG. 3.
Figure 4A:
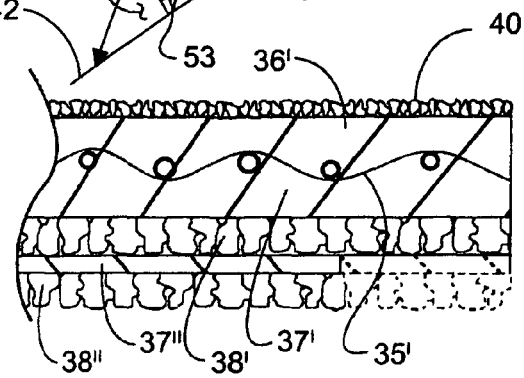

FIG. 4A is an optional fragmentary sectional illustration of any one of the sandwiched panels illustrated in FIG. 3, but wherein an overlay layer is shown beneath the layer of larger granules, to which an additional layer of larger granules is adhered, with the right lower end of the illustration of FIG. 4A being shown in phantom, illustrating that the additional layer of overlay and the additional layer of granules can be applied in whole or in part to the panel, as may be desired.

Figure 4B:
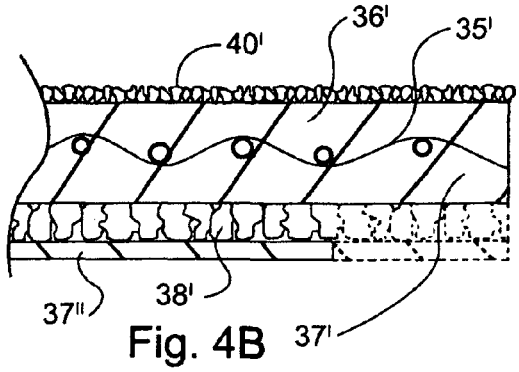

FIG. 4B is another optional fragmentary sectional illustration similar to that of FIG. 4A, but wherein the additional layer of asphalt may be applied in whole or in part, as indicated by the partial phantom illustration therefore, and that a portion of the layer of the larger granules is likewise illustrated in phantom, to illustrate the situation where the layer of larger granules and the underlying layer of asphalt may be applied in whole or in part, to the sandwiched panel, as may be desired.

Figure 4C:
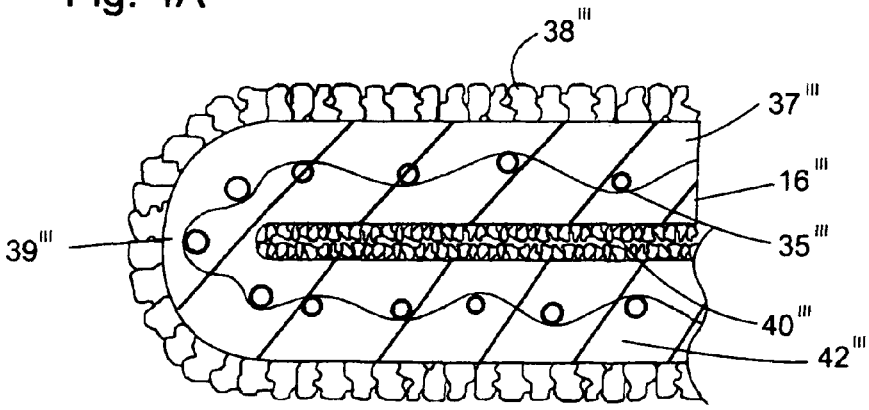

FIG. 4C is yet another optional fragmentary sectional illustration of one of the sandwiched panels illustrated in FIG. 4, but wherein said panel can be folded about itself for additional thickness of that particular sandwiched panel.

Figure 5:
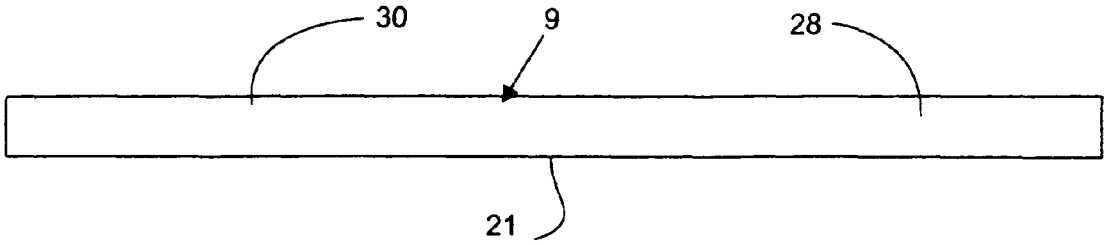

FIG. 5 is an inverted end view of the shingle of FIG. 3, as viewed from the lower end of FIG. 2 after the tabs are folded back.

Figure 6:
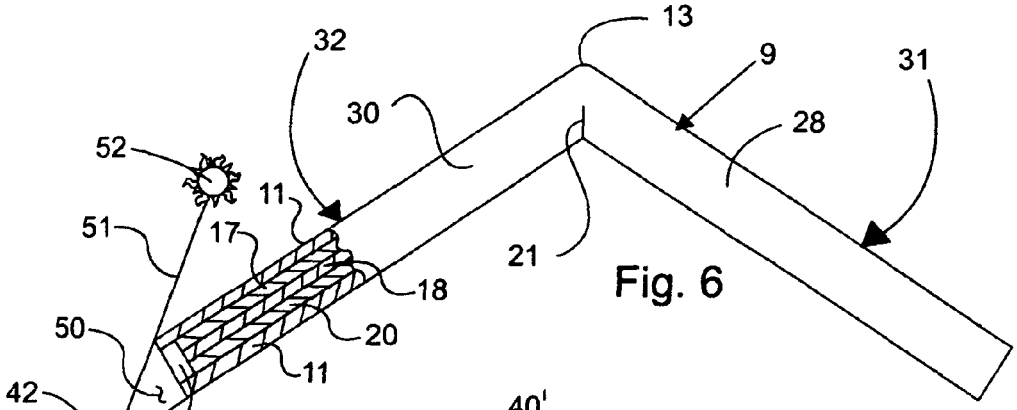

FIG. 6 is a view of the shingle of FIG. 5, wherein the opposite sides of the shingle have been downwardly folded in the direction of the arrows indicated, to form an inverted "V"-shaped configuration, as shown, for application to a roof, with the left side thereof being shown partially broken away to show the manner in which the recessed sides of sandwiched panels facilitate providing a shadow zone on the roof, visually enhancing the thickness of the shingle.

Figure 7:
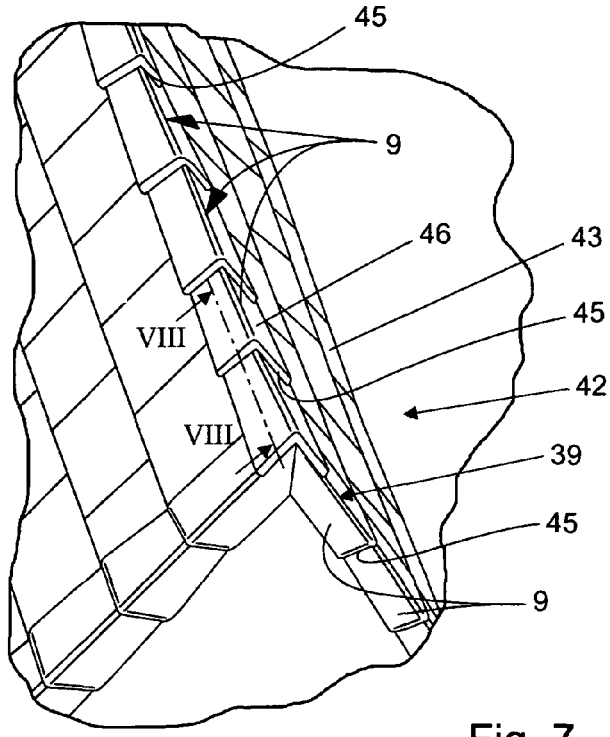

FIG. 7 is a fragmentary illustration of a portion of a roof, with hip, ridge or rake shingles applied thereto, in lapped relation to each other.

Figure 8:
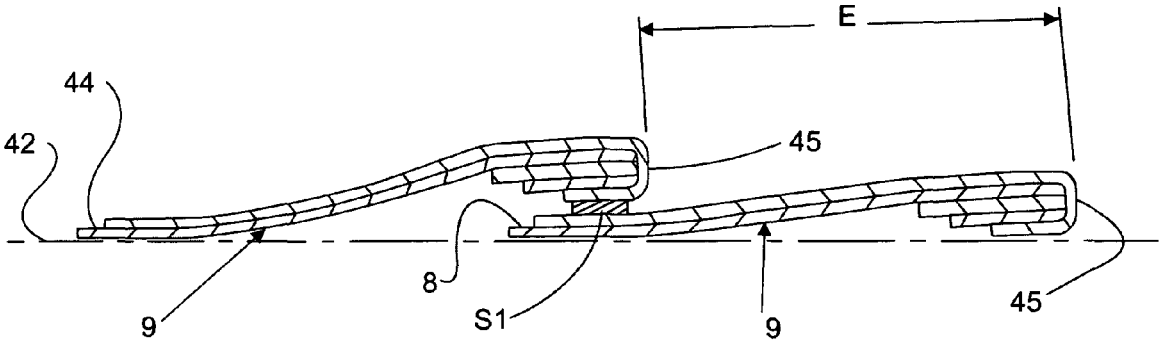

FIG. 8 is a sectional view through two lapped shingles of FIG. 7, taken generally along the line VIII-VIII of FIG. 7.

Figure 9:
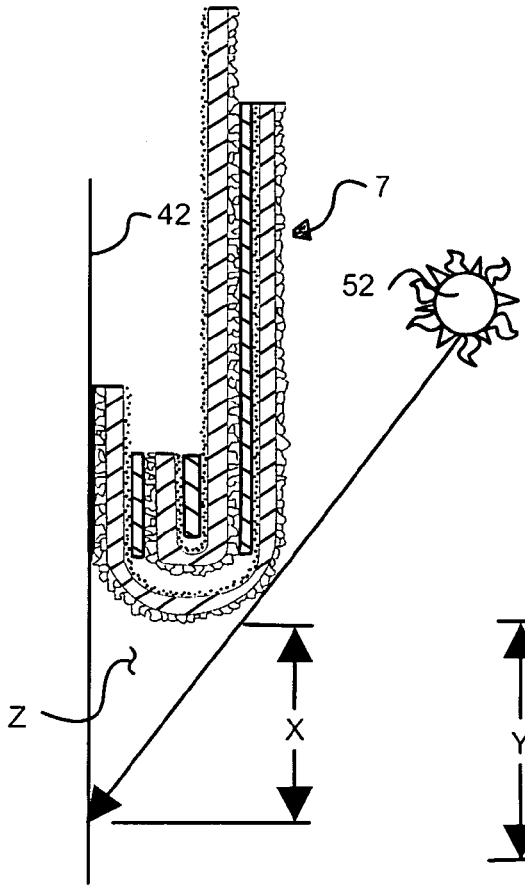
Fig. 9 Prior Art

FIG. 9 is a diagrammatic illustration of the manner in which the sun, from a given angle, can create a shadow of a given length below the lower edge of a shingle in accordance with a prior art type of shingle.

Figure 10:
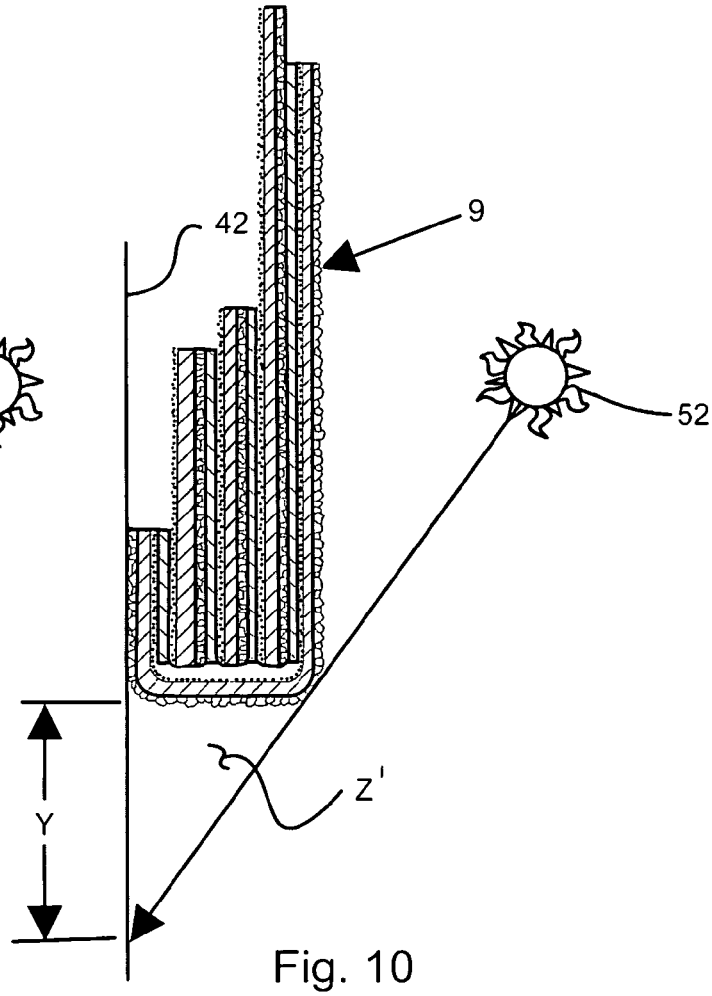

FIG. 10 is an illustration similar to that of FIG. 9, but wherein the sun, from the same given angle, can create a larger shadow beneath a shingle in accordance with this invention.

DETAILED DESCRIPTIONS OF THE PREFERRED EMBODIMENTS

Figure 1:
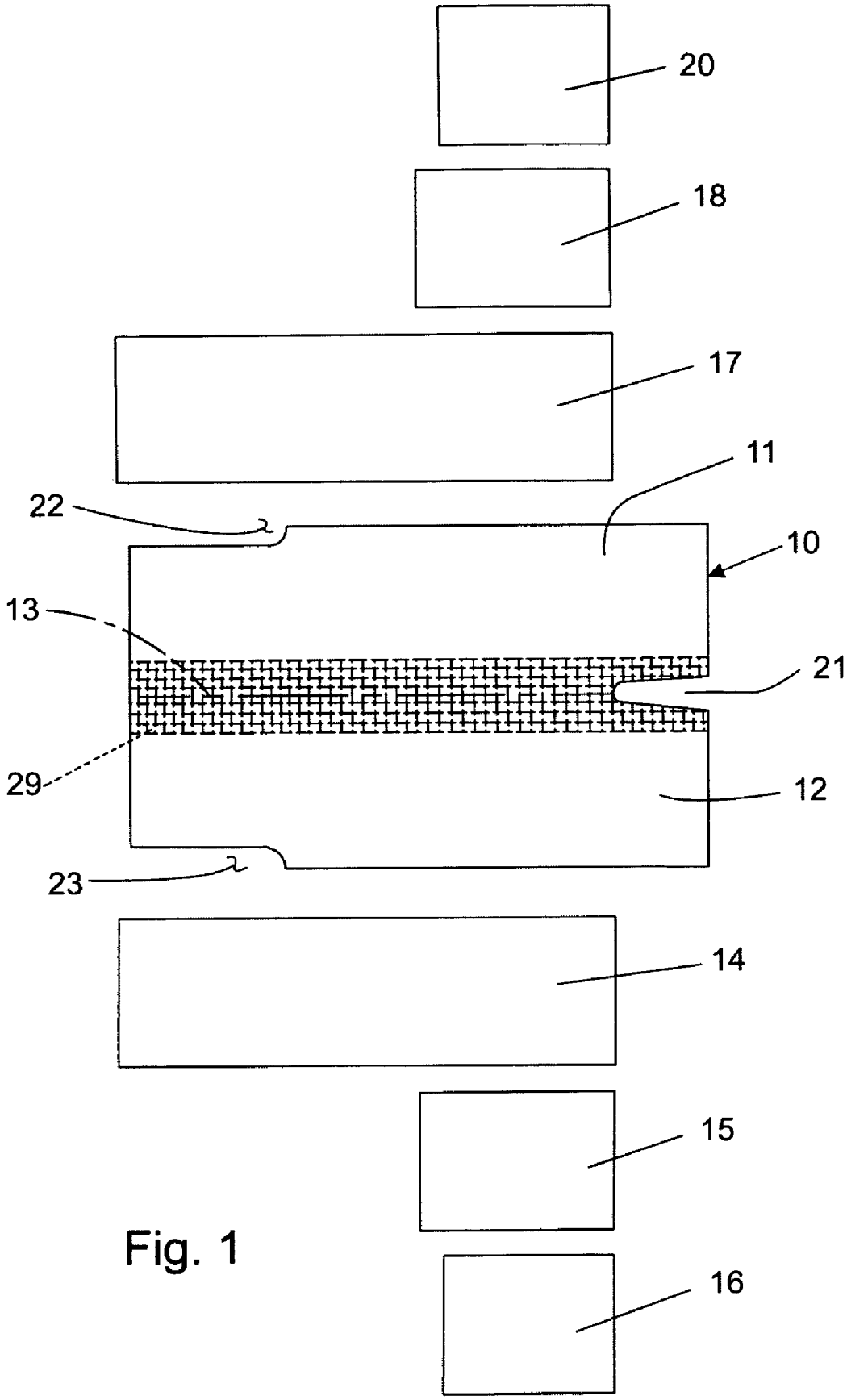

Referring now to the drawings in detail, reference is first made to FIG. 1, wherein the components of the shingle include an outer layer of shingle material 10 comprising two panel portions 11 and 12, connected together, and adapted to be folded along the fold line 13, illustrated in phantom between panel portions 11 and 12.

On the lower side of the illustration of FIG. 1, separate panels of shingle material, 14, 15 and 16, of various lengths are shown. On the opposite side of the layer of shingle material 10, similar panels of shingle material, 17, 18 and 20 are shown.

The panels 10, 14, 15, 16, 17, 18 and 20 comprise the various panels that make up the shingle 9 in accordance with this invention, after being assembled together.

The panel 10 of shingle material has a notched cut-out 21 at the right side thereof as shown in FIG. 1, and, at the left end thereof, cut-outs 22 and 23, as will also later be described herein. While notched cut-out 21 is depicted as U-shaped in FIGS. 1, 2 and 5, it will be understood that the notch alternatively can be V-shaped, rectangular, or take on other shapes useful for accommodating bending along fold line 13 as shown in FIG. 3.

Also, as shown in FIG. 1, a reinforcement scrim or tape 29 is provided along the underside of the outer layer of shingle material 10, traversing the fold line 13, and running along each side thereof. This layer of scrim or tape could be a glass mat or scrim, or could be comprised of polyester or some other fiber or film or treated paper reinforcement as may be desired, in order to reinforce the bend zone of the shingle in case of excessive flexure of the fold during handling, shingle application to a roof, or the like.

With reference now to FIG. 2, the shingle, generally designated 9, is shown in partial built-up form, such that, overlying panel portion 11 of shingle material 10, is panel 17, upon which is stacked and laminated thereto, a shorter panel 18, upon which is stacked thereon and laminated thereto an even shorter panel 20, forming a stack of panel portion 11, and panels 17, 18 and 20, all laminated together.

On the opposite side of the illustration of FIG. 2 is a panel portion 12, with a long panel 14 laminated thereto, to which are stacked thereon and laminated thereto progressively shorter panels 15 and 16, as shown.

The arrows 24 and 25 illustrate the manner in which tabs 26 and 27 of the panel portions 11 and 12, respectively, are adapted to be turned back an amount approximating 180°, to overlie the stacked panels 20 and 16, respectively.

Near the top end 44 of the shingle 9 as shown in FIG. 2, there are strips of release tape T1, T2, adhesively applied across the panels 14, 17, respectively, in the longitudinal or elongate direction indicated by the arrow 19A. These strips of release tape are provided with indicia, in any desired form, such as, for example only, the alpha-numeric indicia XYZ 305, one or more bar codes, as indicated, or any other indicia as may be desired, all in the form of planographic or other indicia, containing some identification, such as, at least one parameter of the manufacture of the shingle, such parameter, if desired, including the specific hour, specific line, and/or specific lane of production of the shingle to which the release material is applied. Such indicia may, if desired be in the form taught in any of U.S. Pat. Nos. 5,951,809 and 6,237,288, the complete disclosures of which are herein incorporated by reference. Alternatively, the indicia could provide an indication of other aspects related to the shingle, for example, language regarding standards, specifications, product information, or the like.

Such release material or layers T1, T2 are thus applied on exposed surfaces of the shingles 10 in accordance with this invention. As the panels and panel portions that comprise the shingle 9 of FIG. 2 are being manufactured, the shingle panels are moved in the machine direction, which is the longitudinal or elongate direction indicated by the arrow 19A, prior to the shingle material being cut transversely (not shown) to the machine direction 19A.

Simultaneously with the application of the release material T1 and T2 being adhesively applied to the shingle, or prior thereto or afterwards, additional strips of release material T3 and T4 can be adhesively applied likewise in the longitudinal or elongate direction indicated by the arrow 19B in FIG. 2, to the underside of the panels 14, 17, at vertical locations as illustrated in FIG. 2 and in a sufficiently wide band to cover a line or band of sealant S1 on the top surface 8 of another shingle stacked thereagainst. Alternatively, T3 and T4 can include indicia as is discussed above, T1 and T2 being optional.

With reference now to FIG. 2A, it will be seen that the band of sealant S1 is likewise applied in the longitudinal or elongate direction 19C, across the top surface 8 of the shingle 9, as shown, with the line or band of sealant S1 being preferably of an asphaltic material, such that, when shingles are laid up in lapped relation on a roof, as will be seen with reference to FIGS. 7 and 8, the line of sealant S1 on the top surface is covered by a lower, backwardly folded portion of a next overlying shingle, facilitating the sealing together of lapped shingles, to prevent inflow of rain, wind or other weather conditions beneath shingles that are laid up on a roof.

Figure 2B:
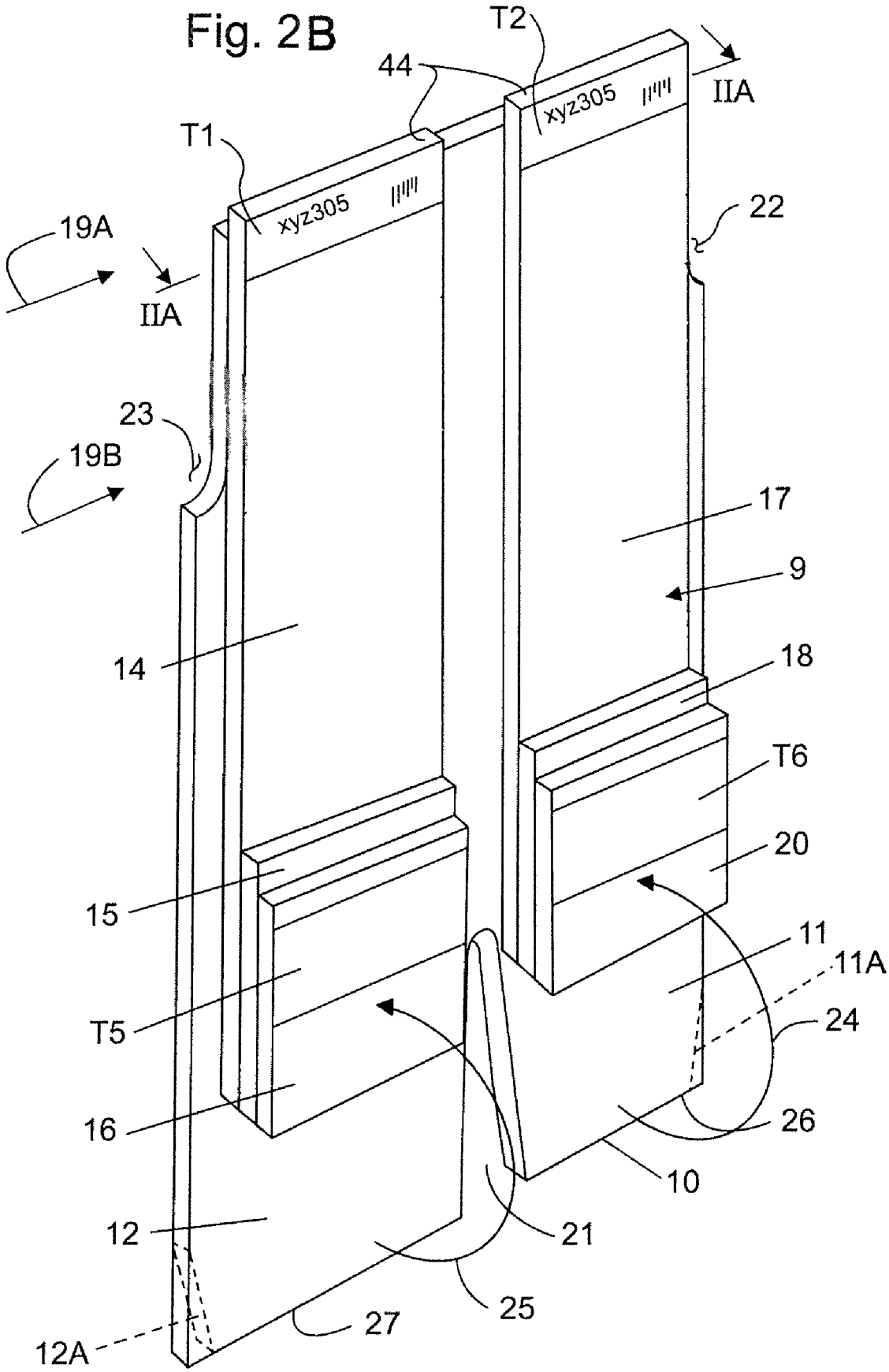
FIG. 2B is an illustration like that of FIG. 2, but with release tape across a different plurality of panels than that shown in FIG. 2.

Thus, when shingles 9 are packaged together, with their top surfaces 8 engaging against the bottom surfaces of panels 14, 17, the line of sealant S1 will be across some portion of the release tape T3, T4, so that adjacent stacked shingles will not stick together in a package as shown in FIG. 2. However, in the event that alternate shingles in a stack are packaged in an inverted manner, such that the top 44 of one shingle as shown in FIG. 2 is at the bottom in alternate shingles (or vertically reversed from that shown in FIG. 2) then, the release tape T3 and T4, instead of being applied at the location shown for the release tape T3 and T4 of FIG. 2, may be applied across panels 16 and 20, as shown in FIG. 2B at T5 and T6, respectively in FIG. 2, for engagement against that portion of the top surface 8 of the shingle 9 having the line of sealant S1 thereon, to prevent sticking together of adjacent shingles in that type of stacked shingle package.

It will also be noted that the line of sealant, S1 can be continuous or such may appear in a broken line, with spaces between portions of sealant, as may be desired.

With reference now to FIG. 3, the shingle embodiment 9 illustrated in FIG. 2 is shown, with the tabs 26 and 27 shown folded back, to sandwich the groups of panels 17, 18 and 20 and 14, 15 and 16, together, on opposite sides of the fold line 13 as shown, and with each half of the shingle 9 of FIG. 3 being folded toward each other along the fold line 13 that connects them together, an amount that will correspond to the included angle between connecting surfaces of a hip, ridge or rake. It will be understood that some variation is allowed for the amount of folding, depending upon the angle between different sloped surfaces to which the shingle 9 is to be applied on a roof.

As shown in phantom in FIGS. 2 and 3, the lower side edges of panel 10 can be angularly cut back or recessed in some other manner as is shown at 11A and 12A, to yield a square leading edge for the shingle 9 at the fold 45, when the shingle is bent or shaped as shown in FIG. 3 to conform to sloped surfaces of a roof.

With reference now to FIG. 4, it will be seen that each layer of shingle material 10, including panel portion 12, and panels 14, 15 and 16, as well as tab 27 that is folded backwardly about 180°, is comprised of a base mat 35 of inorganic or organic material, with asphalt 36, 37 on each side thereof, with preferably a layer of granules 38 on one side, and a layer 40 of either smaller granules, sand, mica or the like on the opposite side, all of which, together, comprise a complete layer of shingle material. It will be understood, that, if desired, the granules 38 and sand, mica, or other parting layer 40 could, if desired, be eliminated from a complete layer of shingle material, but in the preferred embodiments, such are desirable, because they provide additional thickness for the finished shingle 9, in accordance with this invention. Alternatively, for one or more of the sandwiched inner panels of the shingle, the relative placement of the layer of granules 38 and parting layer 40 for a given layer could be reversed. The granules 38 and/or 40 could, if desired, include particles of slag and/or combinations of granules, sand, slag, etc.

The various sandwiched panels 14, 15, 16 and 17, 18, 20 and panel portions 11 and 12 are laminated in stacks, as shown, in FIGS. 2, 3 and 4, with layers 39 or spots of adhesive, such as asphalt or other bitumen or other adhesive, to hold the panels and panel portions together, to form the stacks shown. Additional panels (more than three) can be sandwiched between panel portions 11 and 12, if desired, for greater thickness. While in preferred form, the sandwiched panels 14, 15 and 16 and 17, 18 and 20 are of different lengths, as shown in FIGS. 1, 3 and 4, they could, if desired, all be of the same length in any such stack of panels. Moreover, the sandwiched panels could be made in accordance with the multiplayer teachings of any of U.S. Pat. Nos. 5,052,162 or 6,355,132, if desired, the complete disclosures of which are herein incorporated by reference.

With reference to FIG. 4, it will be seen that the various sandwiched panels 14, 15 and 16 are shown to have relative lengths, so that the overall shingle has a stepped thickness, as shown in FIG. 4, running from right to left, to effectively yield a gradient of thickness from the left side or fold 45, to the right-most side, thereby running from thicker to thinner overall thickness for the shingle 9, from the fold line 45, rightwardly. Similarly, panels 17, 18 and 20 likewise provide such a gradient of thickness.

With reference now to FIG. 4A, it will be seen that the fragmentary illustration for each or any of the sandwiched panels 14, 15 and/or 16 and 17, 18 and/or 20 is shown, as having other thickening possibilities. For example, the mat 35' can have layers of asphalt 36', 37', on opposite sides of the mat 35', with a layer of larger granules 38' applied therebeneath, and a layer of smaller granules of the sand, mica or like types 40', as discussed above, applied at the top as shown in FIG. 4A. An additional layer of asphalt 37" could be applied beneath the layer of larger granules 38', as shown, to which is applied another layer of larger granules 38", to yield additional thickness for any or all of the sandwiched panels. At the right side on the lower end of FIG. 4A, it will be seen that the right-most portion of the additional layer of asphalt 37" and the rightmost portion of the layer of larger granules 38" are shown in phantom, to illustrate that such layers could be complete, running to the right end of the illustration of FIG. 4A as shown, or could run from the left end thereof, partially to the right end of the illustration of FIG. 4A, as may be desired.

With reference now to FIG. 4B, it will be seen that another variation may be provided for any or all of the sandwiched panels, such that the layer of mat 35', would likewise be provided with asphalt 36' and 37', on each side thereof, with a layer of larger granules 38' applied beneath the layer 37' as shown, and with a layer 40' of smaller granules applied to the top of the asphalt layer 36', as shown. In this variation, there may be provided an additional layer of asphalt 37", either running completely across the bottom of the panel portion illustrated in FIG. 4B, or partially thereacross, as shown in phantom at the right side on the lower end of FIG. 4B. Likewise, the layer of granules 38' may completely cover the bottom of the asphalt layer 37' as shown, or may partially cover the same, as shown in phantom at the right lower end of FIG. 4B.

With reference to FIG. 4C, it will be seen that any of the sandwiched panels 14, 15 and/or 16 and 17, 18 and/or 20 may be provided in the form of a folded panel 16''', comprised of a layer of mat 35''', with layers of asphalt 37''', 42''' on each side of the layer of mat 35''', as shown, and with a layer of smaller granules 40''', sandwiched therebetween, as shown, and with a layer of larger granules 38''' applied outside the asphalt layer 37''', with the panel configuration of FIG. 4C being folded about fold line 39''', to provide additional thickness for that panel. If desired, all six of the panels 14, 15 and 16 and 17, 18 and 20 may be constructed in accordance with FIG. 4C, or any of the panels may be constructed in accordance therewith, all as may be desired.

With reference to FIG. 5, the completed shingle of FIG. 3 is shown, but in flattened form, wherein each half 28, 30 of the shingle 9, is shown, ready to be folded from its flat form as shown in FIG. 5, to its shaped or prefolded form as shown in FIG. 6, along fold line 13, substantially closing the notched cut-out 21 therebetween, as the opposite sides 28, 30 of the shingle of FIG. 5 are moved downwardly in the direction of the arrows 31 and 32, respectively, as shown in FIG. 6.

In FIG. 6, the left-most side of the shingle 9 is shown fragmentally broken away, such that the sandwiched panels 17, 18 and 20 are shown recessed at 53, from the full extension of the upper and lower portions of the folded panel portion 11, creating a shadow zone 50 when light from the sun 52 approaches the shingle 9, in the direction of the arrow 51, thereby visually enhancing the appearance of, and actuality of, thickness for the shingle 9.

With reference now to FIGS. 7 and 8, a roof 42 is shown, having a plurality of shingles 43, laid up in courses, as is shown, but wherein the novel hip, ridge or rake shingles 9 are shown laid up in overlapping relation to each other, such that each overlying shingle 9 covers a rearward portion 44 of the immediately underlying shingle, leaving the folded tab portion 45 exposed.

With reference to FIG. 8, a plurality of hip, ridge or rake shingles 9 are likewise lapped, leaving an exposure E as shown in FIG. 8, of preferably 8 inches. As can be seen in FIG. 8, the line or band of sealant S1 on top surface 8 of the right-most shingle engages and adheres to the lower surface of the backwardly folded tab of the overlying left-most shingle 9, adhering together adjacent shingles to prevent inflow of rain, wind, or other weather conditions.

With reference again to FIG. 3, and as aforesaid, it will be seen that, moving from the fold line 45, where the tabs, 26, 27, connect to the visible portion of the shingle when installed, rightwardly as shown in FIG. 3, toward the opposite end 44 of the shingle 9, the shingle ranges from a greater thickness dimension D1 adjacent the folds 45 of the tabs 26, 27, to a reduced, stepped thickness dimension D2 as measured from the folds 45, back toward the opposite ends 44 of the shingle, due to the different lengths of the panels, 20, 18, 17 and 16, 15 and 14. Thus, when the shingles are laid up on hips, ridges or rakes as illustrated in FIG. 7, the greatest thicknesses will be at the folded ends 45 of the shingles, yielding a staggered appearance along a hip, ridge or rake, from shingle-to-shingle.

It will be understood that the outer surface of the shingle 9 may be constructed such that the granules 38 applied thereto may comprise a blend of various color granules, to be consistent with the color of the shingles 43 that are applied to the roof 42, as shown in FIG. 7. In some embodiments, there may be a color blend variation from shingle to shingle, or within a given hip, ridge or rake shingle, the color blend variation being consistent with a color blend variation exhibited by the shingles 43 that are applied to the roof 42. It will also be seen that the shingles in accordance with this invention present lower edges that are as many as 5 layers thick of complete shingle material, as shown in FIG. 4, comprising the top visible-when-installed surface layer of shingle material, the folded back tab portions 26, 27, and the panels that are sandwiched therebetween. Thus, as viewed from below, a roof 42 gives the appearance of having thick hip, ridge or rake shingles, and at the outer fold 45, only a single layer of complete shingle material is folded backwardly, as shown in FIG. 4, thereby reducing or eliminating any tendency for cracking of the folded-back layer.

With reference to FIG. 9, it will be seen that when a prior art type of shingle 7 is applied to a roof 42, and when the sun 52 confronts the lower, rounded end of that shingle, a shadow zone or line Z is provided, extending beneath the lower end of the shingle, for a distance "X".

In FIG. 10, there is a similar illustration to that of FIG. 9, but wherein a shingle 9, in accordance with this invention, is applied to a roof 42, and wherein the sun 52 when confronting the lower, squarer end of the shingle 9 it produces a larger shadow zone or line Z' for a distance "Y" greater than the "X" of FIG. 9, when the sun intersects the lower end of the shingle 9 at the same angle as that illustrated in FIG. 9.

Thus, in accordance with this invention, the shingle 9 produces an even greater visual perception of thickness, due to the enhanced shadow effect provided by a shingle constructed of a single outer layer, with a plurality of intermediate panels sandwiched therebetween.

It will be apparent from the forgoing that various modifications may be made in the details of construction, as well as in the use and operation of the shingles in accordance with this invention, all within the spirit and scope of the invention as defined in the appended claims.

The invention claimed is:

1. A hip, ridge or rake shingle comprised of:

(a) an outer layer of shingle material comprising two panel portions connected together to form a fold line therebetween;

(b) each panel portion of the outer layer having an associated stack comprising a plurality of panels of shingle material disposed thereon at an end of said shingle and being in stacked relation, with the plurality of panels being laminated together with their associated said panel portion; with said stacks being spaced apart from each other across the fold line in the outer layer of shingle material, with each panel portion of the outer layer being foldable along the fold line to accommodate different angles of different sloped surfaces to which the shingle is to be applied;

(c) with each panel portion having a tab fold comprised of a tab folded around the stacked plurality of panels at said end of said shingle;

(d) with each said tab being folded approximately 180° relative to its panel portion, defining a tab fold and sandwiching said plurality of panels between said tab and panel portion and covering edges of each panel in said plurality of panels;

(e) wherein each stack of panels is comprised of panels of different lengths measured from the end of the shingle having the tab folds, whereby the shingle on each side of the fold line that connects the panel portions is of reducing, stepped thickness as measured from the tab folds, toward the opposite end of the shingle; and (f) with the outer layer of shingle material and each panel in each stack being comprised of a base mat with asphalt on each side of the base mat and with a layer of granules on one side of the base mat and a layer of smaller particles on the other side of the base mat.

2. The shingle of claim 1, wherein the stacked panels and their associated panel portions are adhered together, in laminated relation.

3. The shingle of claim 1, wherein each tab fold and the fold line in the outer layer of shingle material is comprised of only a single thickness layer of complete shingle material.

4. The shingle of claim 1, wherein each plurality of panels comprises at least two panels.

5. The shingle of claim 1, wherein each plurality of panels comprises at least three panels.

6. The shingle of claim 1, wherein the tabs of each panel portion are spaced apart by a notched cutout.

7. The shingle of claim 6, wherein the notched cutout is substantially in alignment with said fold line between said panel portions.

8. The shingle of claim 1, including a release tape on a surface of the shingle.

9. The shingle of claim 8, wherein the release tape is provided with indicia thereon, with said indicia having identification being selected from the group consisting of at least one parameter of manufacture of the shingle, standards information, specification information, and product information.

10. The shingle of claim 8, wherein the shingle has a line of adhesive on one outer surface, for adhering together overlying and underlying lapped shingles when installed on a roof, and wherein the release tape is applied to an opposite outer surface of the shingle, at a location on said opposite outer surface comprising means for preventing adjacent shingles in a stack of shingles from sticking together.

11. A roof having a plurality of shingles thereon, wherein the shingles are constructed in accordance with any one of claims 1-7 and 8-10, and wherein the shingles are arranged such that there are underlying shingles and overlying shingles, with overlying shingles partially covering underlying shingles, in lapped relation.

12. A package of shingles comprising a plurality of shingles in accordance with claim 1.

13. A roof having a plurality of shingles thereon, wherein the shingles include a hip, ridge or rake shingle comprised of:

(a) an outer layer of shingle material comprising two panel portions connected together to form a fold line therebetween;

(b) each panel portion of the outer layer having an associated stack comprising plurality of panels of shingle material disposed thereon at an end of said shingle and being in stacked relation, with the plurality of panels being laminated together with their associated said panel portion; with said stacks being spaced apart from each other across the fold line in the outer layer of shingle material;

(c) with each panel portion having a tab fold comprised of a tab folded around the stacked plurality of panels at said end of said shingle;

(d) with each said tab being folded approximately 180° relative to its panel portion, defining a tab fold and sandwiching said plurality of panels between said tab and panel portion and covering edges of each panel in said plurality of panels;

(e) wherein each stack of panels is comprised of panels of different lengths measured from the end of the shingle having the tab folds, whereby the shingle on each side of the fold line that connects the panel portions is of reducing, stepped thickness as measured from the tab folds toward the opposite end of the shingle; and (f) with the outer layer of shingle material and each panel in each stack being comprised of a base mat with asphalt on each side of the base mat and with a layer of granules on one side of the base mat and a layer of smaller particles on the other side of the base mat;

and, wherein the shingles are arranged such that there are underlying shingles and overlying shingles, with overlying shingles partially covering underlying shingles, in lapped relation wherein each panel portion of the outer layer of each shingle is folded along the fold line to accommodate different angles of different sloped surfaces of the roof, to which the shingle is applied.

14. The shingle of claim 1, including a layer of reinforcement along the fold line beneath the outer layer of shingle material.

15. The roof of claim 13, including a layer of reinforcement along the fold line beneath the outer layer of shingle material.

* * * * *